United States Patent [19]

Zag et al.

[11] Patent Number: 4,908,102

[45] Date of Patent: Mar. 13, 1990

[54] DEVICE FOR CONTINUOUSLY DEWATERING A FIBER WEB

[75] Inventors: Heinz Zag; Albrecht Meinecke, both of Heidenheim; Otmar Kolb, Königsbronn; Josef Müllner, Heidenheim; Elemer Csordas, Heidenheim; Dieter Egelhof, Heidenheim, all of Fed. Rep. of Germany

[73] Assignee: J. M. Voith GmbH., Fed. Rep. of Germany

[21] Appl. No.: 641,409

[22] Filed: Aug. 16, 1984

Related U.S. Application Data

[63] Continuation of Ser. No. 433,205, Sep. 30, 1982.

[30] Foreign Application Priority Data

Feb. 28, 1981 [DE] Fed. Rep. of Germany ..... 3107730
Jun. 11, 1981 [DE] Fed. Rep. of Germany ..... 3123132

[51] Int. Cl.[4] ..... D21F 1/66

[52] U.S. Cl. ..... 162/264; 162/190; 162/301; 162/DIG. 7

[58] Field of Search ..... 162/264, 190, 301, DIG. 7

[56] References Cited

U.S. PATENT DOCUMENTS

| | | | |
|---|---|---|---|
| 3,846,232 | 11/1974 | Kankaanpaa | 162/301 |
| 4,113,556 | 9/1978 | Kankaanpaa | 162/301 |
| 4,207,144 | 6/1980 | Meinecke et al. | 162/300 |
| 4,209,360 | 6/1980 | Stenberg et al. | 162/301 |
| 4,220,502 | 9/1980 | Levanen | 162/300 |
| 4,267,017 | 5/1981 | North | 162/301 |
| 4,425,187 | 1/1984 | Armstrong et al. | 162/299 |

FOREIGN PATENT DOCUMENTS

| | | | |
|---|---|---|---|
| 19408 | 2/1978 | Japan | 162/301 |

*Primary Examiner*—Peter Chin
*Attorney, Agent, or Firm*—Ostrolenk, Faber, Gerb & Soffen

[57] ABSTRACT

This device, preferably formed as a dual screen paper machine, has according to a preferred embodiment two endless screens, mainly a lower screen (21) and an upper screen (22). The lower screen (21), on which is formed a paper web, and the upper screen (22) are moved together in the lower part of a dehydration cylinder (25) arranged in the upper screen. Both screens (21,22) are unrolled from the rising lower quadrant of said clyinder (25) and are laid on the upper part of the support cylinder (26) arranged in the lower screen (21). The bandage of the dehydration cylinder (25) has hollows which absorb water from the screens along their arcs of contact with the cylinder and which project the water towards the inside of the loop formed by the screens of the cylinder. In the feed direction of the screens and downstream of the support cylinder (26), there is arranged a receiving container (36) for the projected water. The container has a curved covering wall (40) which extends opposite the feed direction of the screens up to the interstice formed between the dehydration cylinder (25) and the screens (21,22). The reception container (36) is divided into two chambers (44,45) which extend transversally to the screens and which have separate side discharge conduits. The water supplied into the main chamber (45) through the covering wall (40) is deviated by means of blades (52) towards the direction of the discharge conduit.

34 Claims, 4 Drawing Sheets

Fig. 1
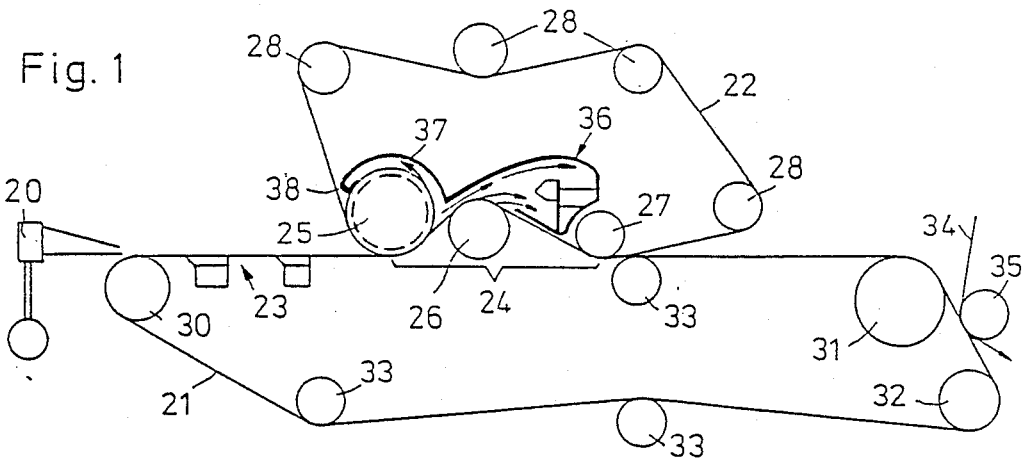
Fig. 9
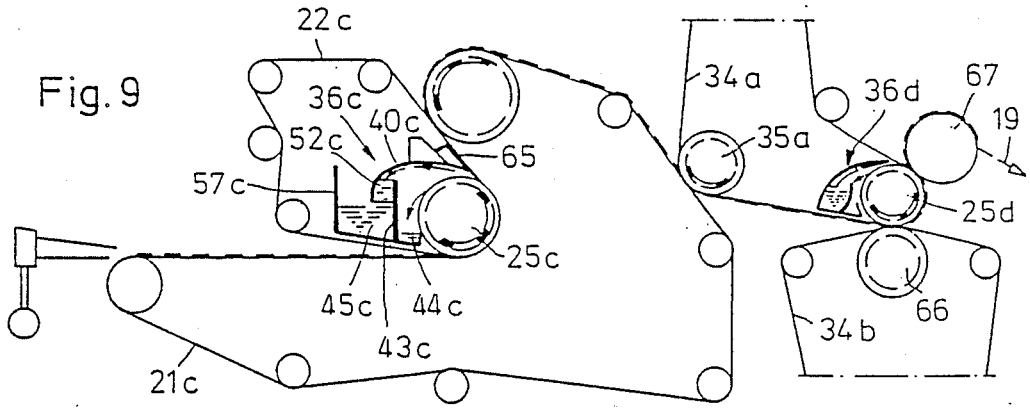
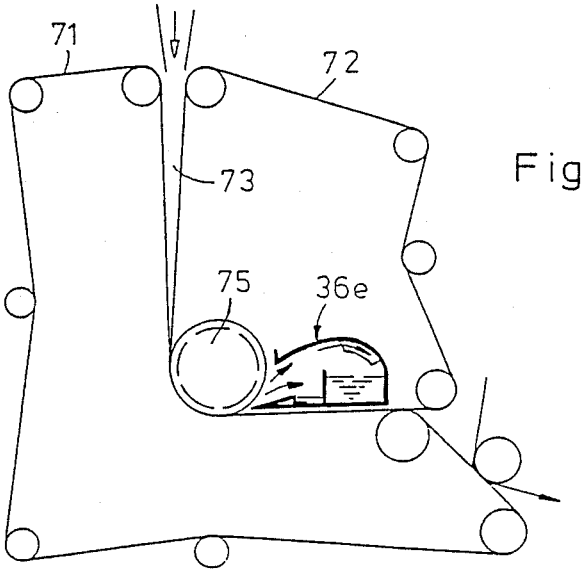
Fig. 10

Fig. 2
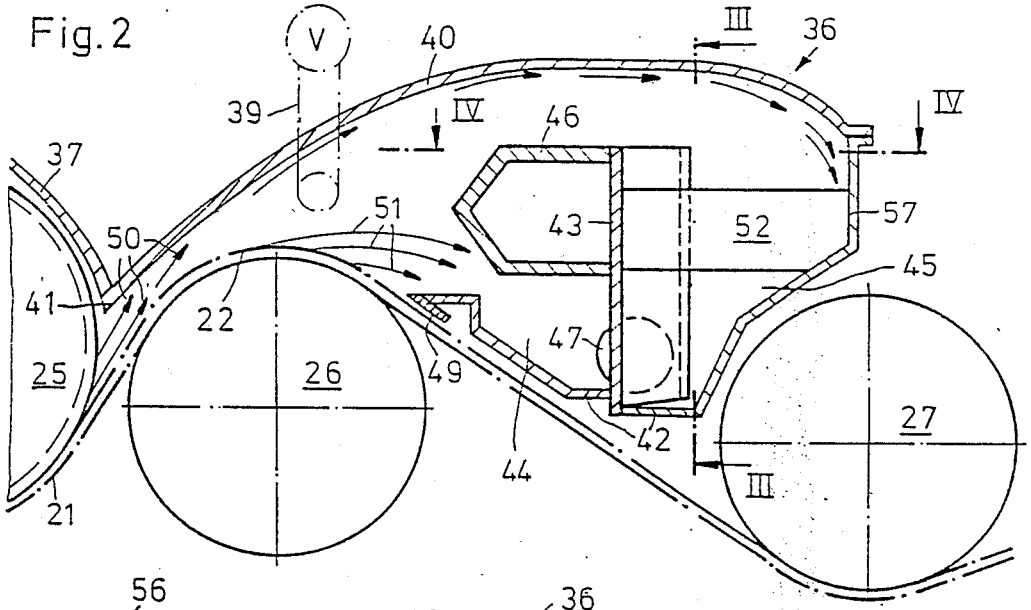
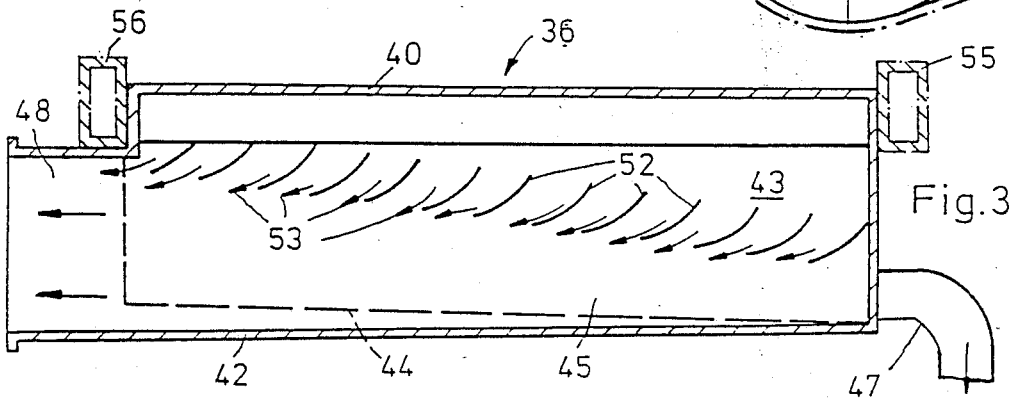
Fig. 3
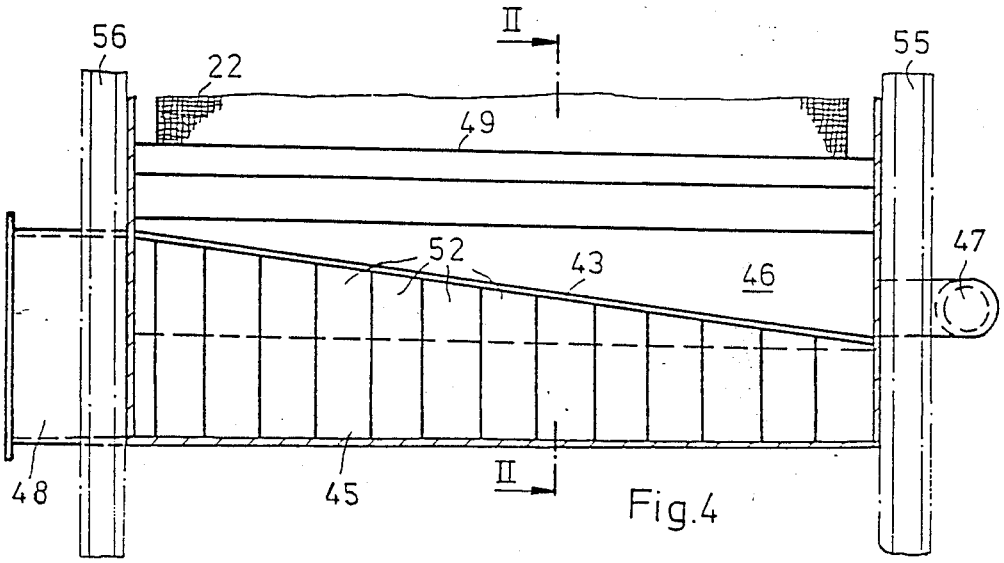
Fig. 4

Fig. 5
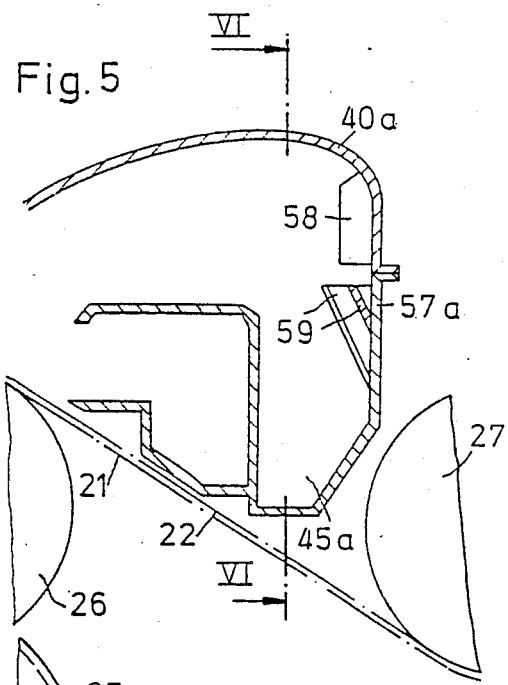
Fig. 6
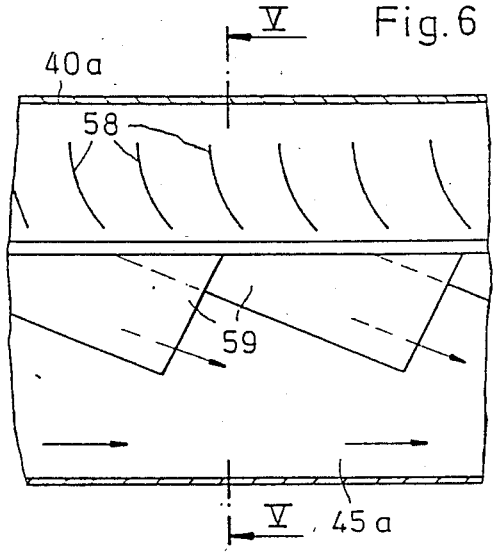
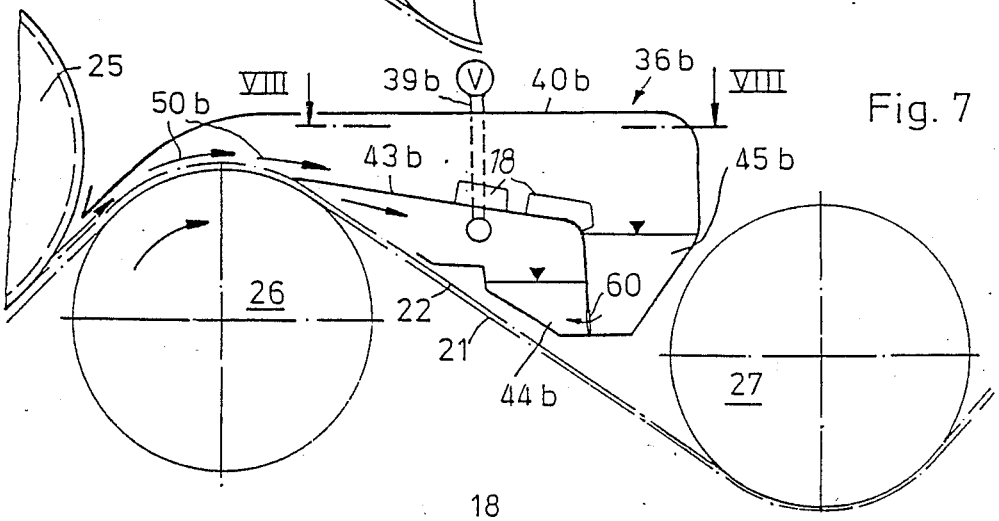
Fig. 7
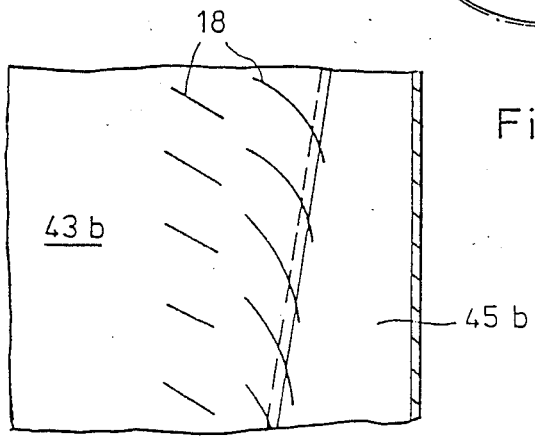
Fig. 8

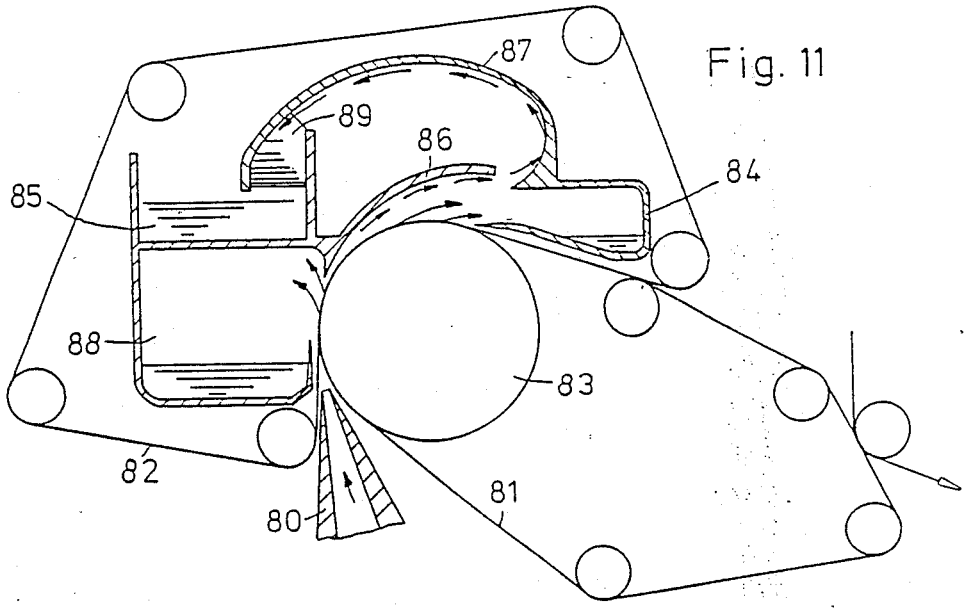
Fig. 11
Fig. 12
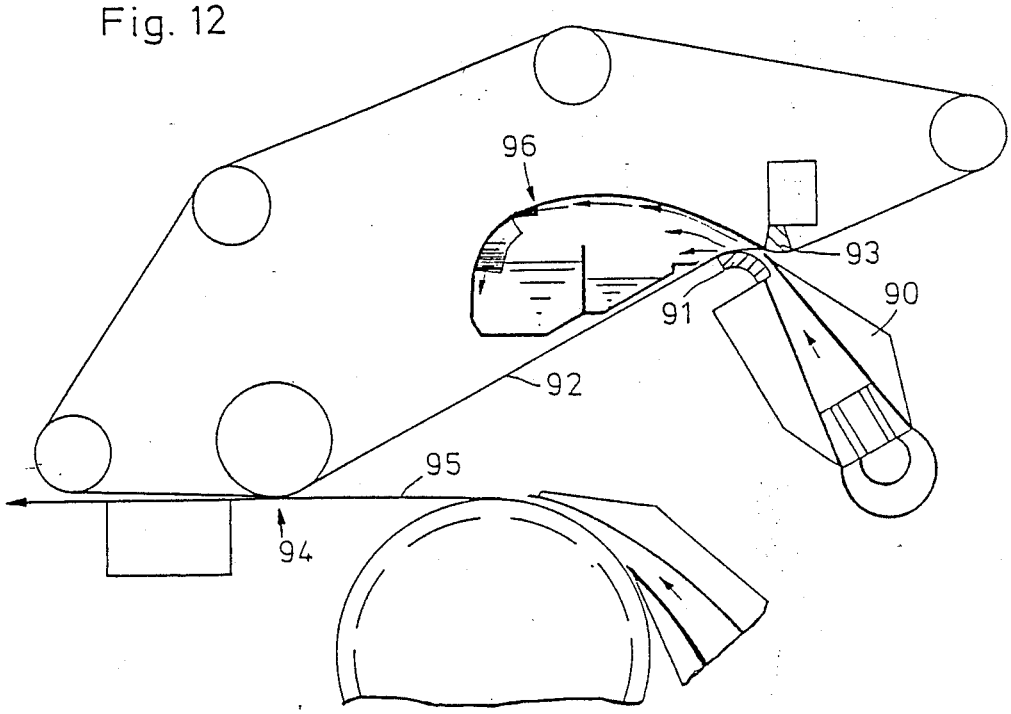

DEVICE FOR CONTINUOUSLY DEWATERING A FIBER WEB

This is a continuation of application Ser. No. 433,205, filed Sept. 30, 1982 for Device for Continuously Dewatering a Fiber Web.

TECHNICAL FIELD

The present invention relates to a device for the continuous dewatering of a fiber web, which in detail has the features which are set forth in the preamble to claim 1. There is preferably involved a paper machine in which the continuously formed web of fibers (paper web) is conducted, at least for a short distance, along the underside of an endless porous belt. The fiber web is, as a rule (but not necessarily) additionally guided within said distance from below by another belt guidance element, for instance a second wire belt (twin-wire paper machine). In all cases at least a part of the dewatering of the fiber web takes place in the manner that water which is removed from the fiber web passes in upward direction through the first-mentioned porous belt.

PRIOR ART

1. West German Provisional Patent AS 2 100 964 corresponding to Canadian Patent 886,306

2. U.S. Pat. No. 4 220 502

3. British Pat. No. 3583/1877

4. West German Unexamined Application for Patent OS 2 102 717 corresponding to U.S. Pat. No. 3,876,499

5. U.S. Pat. No. 3 844 881

6. U.S. Pat. No. 4 209 360

The twin-wire paper machine described in Reference 1 has two wires which pass together over a certain distance through a twin-wire zone. A web of paper is formed and dewatered within this twin-wire zone. The upper wire (which corresponds to the aforementioned porous belt) travels over a dewatering roll at the start of the twin-wire zone. The shell of the roll has recesses which temporarily receive water which passes through the upper wire in upward direction. This water is thrown out from the shell of the roll directly behind or down stream of the zone of wrap as seen in the direction of rotation. The two wires travel together over a curved slide shoe and over a support roll which is developed as a suction roll. These two elements are arranged within the lower wire. In the region of these elements the upper wire throws a further amount of water off in the upward direction. Within the loop of the upper wire a container is arranged which serves to receive the water which is thrown off and which has an upwardly curved covering wall (guide wall) and a lateral outlet channel. A similar device is described in Reference 2.

Other known paper machines differ from those described above essentially merely by the fact that a horizontal pre-dewatering path formed by the lower wire is provided upstream of the twin wire zone; see for instance Reference 3, FIG. 3 or FIG. 5.

Upon the operation of such paper machines at high operating speeds difficulties are encountered in conducting towards the outside the water which has been thrown into the inside of the upper-wire belt loop. One difficulty is that the jets of thrown off water mix in part with air so that a large amount of air is drawn in and discharged through the outlet channel in the form of a mist. On the other hand, the danger may be present of a part of the jets of water falling back again on the upper wire and being again thrown off. As a result fines may be undesirably washed out of the web of paper.

The problem is further increased when a predewatering path as mentioned above is present. In such case, the loop of the dewatering roll which is arranged in the upper wire is-differing from the case of Reference 1-wrapped for a distance by both wires. As a result, the amount of water temporarily stored by the dewatering roll and then thrown into the belt loop is increased. This is true also in the case of Reference 4. There are also cases in which water passes into the inside of the upper wire solely from the dewatering roll. One example of this is the twin-wire paper machine of Reference 5. In that case a suction box 46 is provided behind or dowbnstream of the point where the wire belts move off from the dewatering roll. Above the box a container 48 is arranged to receive additional water. Since a space is present between these two devices and since only relatively small amounts of water can be led away with these devices it is necessary to develop the dewatering roll 30 as a suction roll. In this way a part of the water can be discharged over the suction boxes 32, 36 arranged within the roll 30. One disadvantage, however, is that the manufacturing and operating expenses for such a suction roll are very high.

In the known manner of construction described above, the dewatering roll throws the water to be collected off (with respect to the direction of rotation of the roll) partially in the lower and partially in the upper ascending quadrant of the shell of the roll. Similar problems occur when the wires move away from the dewatering roll only in the upper ascending quadrant so that a part of the water is thrown off only in the descending quadrant. The collection container is therefore arranged in this case in the region of the descending quadrants of the shell of the roll, in which connection it is frequently desirable for the lower limitation of the inlet cross section to be as low as possible. In this way, however, narrow limits are placed on the capacity of the container.

In most cases the arrangement is such that the porous belt (upper wire) wraps at least predominantly around the lower region of the shell of the dewatering roll. In other words, the porous belt as a rule comes from above-although, to be sure, in approximately horizontal direction in favorable cases-to the lower region of the shell of the roll. Furthermore, as a rule it moves more or less steeply in upward direction then away from the shell of the roll. Therefore, collection containers which are arranged within the loop of the belt can never be increased in size in the region present below the dewatering roll, as is possible, for instance, in the case of the container 41 shown in FIG. 1 of Reference 6.

DESCRITPION OF THE INVENTION

The object of the present invention is to improve the device having the following features. The device is provided for continuous dewatering of a web of fiber material in a paper making machine. A porous belt in loop form is provided for water to pass through. The belt is guided by guide rolls so that the belt may move longitudinally. The belt is adapted for receiving the fiber web to be dewatered on one surface of the belt, and particularly the undersurface, at the bottom of its run. There are guide rolls placed to cause the belt to move at a speed such that at least part of the water which has been removed from the fiber web penetrates through the belt and is thrown off the other surface of the belt inside the loop. There is a container placed near the belt inside the loop for receiving the water that is thrown off. The container includes a guide wall for guiding the thrown off water into the container and the container has an exit for the water. The invention is designed in such a manner that the collection container for the water to be led away within the belt loop is adapted, despite small overall dimensions, to transport a substantially larger amount of water than previously.

This object is achieved by the device in accordance with the invention, wherein the container is divided into two separate water containing chambers. Each of the chambers extends across the width of the belt from which the water is thrown and each chamber has a respective water exit. The guide wall of the container is shaped and positioned for directing the more dense water jets of the thrown off water into a first one of the chambers, which would be called the main chamber. The observation, that the water which is thrown off into the inside of the belt loop is, within a relatively sharply delimited zone, in the form of relatively dense jets while outside of this zone it is in the form of finely dispersed droplets, led to the present invention. In other words, the water is in part mixed with only a small amount of air and in part (in mist-like manner) with a very large amount of air.

A further step in the direction towards the invention resides in the recognition of the fact that the portion of water thrown off in the form of relatively dense jets (the so-called main water portion) can be guided by the guide wall of the container with only a slight loss of velocity into the collecting container. The shape of the guide wall is for this purpose adapted to the natural approximately parabolic path of sling of the main portion of water. Sudden abrupt deflections are avoided.

In addition to this, there is also the further important finding that the space required for collecting the water within the belt loop and for the lateral removal of the water can be substantially reduced if the main portion of water which is guided in the collection container in the manner just described is not mixed with other portions of water but is discharged separately from them, utilizing its kinetic energy.

Therefore, the manner of construction of the invention is characterized in particular by the fact that the said main portion of water is deflected, as free of loss as possible, in the direction toward the lateral exit channel within the said; main chamber, which is separated from the rest of the collection container by means of guide surfaces, guide vanes or the like.

As a rule, the main portion of water which passes at high speed into the collection container is also quantitatively the greater part of the total amount of water obtained. Due to the fact that, in accordance with the invention, mixing of this portion of water with other portions of water within the collection container is avoided, its high velocity of flow is substantially maintained over the entire flow path (including exit channel) so that only relatively small cross sections of flow are necessary. In the final result thus the space the loop is the porous belt can be utilized far better than previously. In other words, with the same overall dimensions one can pass larger quantities of water, or else the height and/or length of the space taken up by the belt loop can-other conditions remaining the same-be reduced.

Particularly favorable results are obtained by the guide wall having an upstream front edge which is located at the start of the throw off or slinging off of the water from the belt. The upstream front edge of the guide wall is spaced from the surface of the belt and defines the path of the thrown off water. The guide wall extends back toward the starting point of the throw-off of the water, and the guide wall is arched upwardly to generally follow the path of throw-off of water from the belt. In this way the water jets are taken up by the guide wall immediately after the slinging or throw off (for instance the water is thrown out of the recesses of a dewatering roll). As a rule the guide wall is an upwardly arched cover wall of the collection container. The curvature, as already mentioned, will be adapted to the parabolic course of the jets of water. Thus the jets of water are taken up by the lower side of the guide wall with only slight deflection, as a result of which they are further consolidated. Therefore it is seen to it at the start of the sling path that the portion of air in the main portion of water is still further reduced. In other words, it is seen to it that from the very start much less air is entrained by the water which is thrown off.

The guide wall is curved in such a manner that the liquid jet flowing along it is subject to a centrifugal force from which a downward directed centripetal lifting force for the air results. Under the action of this force practically complete separation between water and air takes place. The main portion of water thus passes as a compact water jet into the collection container, as a result of which the effect of the above-described measures (separate guidance through the separate main chamber) is substantially further improved.

Particularly good utilization of the space available can be with the exit from one of the chambers being at one lateral side of the container, with respect to the path of the belt past the container, and the exit from the other chamber being at the opposite lateral side of the container. The container may also be shaped so that the respective inside widths of each of the chambers of the container, measured along the path of the belt, increases laterally of the container in the direction toward the respective exit from each chamber. When, for instance, two chambers are present they are separated from each other by a diagonal partition located in the container.

The utilization of the kinetic energy of the water which passes through the main chamber can be further improved in the manner that the main chamber passes without any constriction into the exit channel.

The belt is guided along a path to throw water off the belt initially predominantly obliquely upwardly. The chambers of the container are arranged one after the other in the path of the belt which is the path along which the water is thrown. The main chamber which receives the greater amount of thrown water is further from the place on the belt from which the water is thrown.

Both chambers have respective lower limiting walls to define their bottom sides. These lower limiting walls have substantially the same geodetic height. The inside height of the main chamber, which receives the greater amount of water, is greater than the inside height of the other chamber.

For reducing the quantity of air in the container, vacuum producing means may be connected with the container. This helps reduce space requirements and prevents air pressure build-up.

The two chambers may be separated by a wall. The wall may extend up to the start of the throw off point of the water.

Furthermore, the two chambers may be at least substantially sealed from each other for enabling different respective pressures to be established in the different chambers.

The previously explained features of the invention can be employed to particular advantage in the case of a twin-wire paper machine with the upper belt being guided by guide rolls and defining a closed loop having the container inside it. A dewatering is provided at the bottom of the path of the upper belt loop. In this case, the belts are wires of a paper making machine. The wire pass under the dewatering roll and wrap around the underside of the dewatering roll. The wires in that case travel preferably at an angle of 45° to 60° to the horizontal from the dewatering roll obliquely upwards and are then deflected downwards by means of a support roll. The main portion of water is in this connection (assuming an average wire speed of about 800 meters per minute) thrown upwards out of the dewatering roll at an angle of about 50° to 70° . The dewatering roll here preferably has recesses which receive and hold water as the belt passes around that roll and throws off the water once the belts separate from the roll. The container for thrown off water is located downstream of the dewatering roll and of where the dewatering roll throws off water. Preferably, the upstream front edge of the guide wall is arranged within a wedge-shaped nip that is defined between the dewatering roll and the upper wire. The collection container is arranged-corresponding to the arrangement in accordance with Reference 1-downstream of the support roll as seen in the direction of travel of the belt. Behind it, again at the shortest possible distance away, there is another guide roll lying within the upper wire so that here also the space for the container is very limited. In addition to this there is the fact that the dewatering roll should, for reasons of process technique, remain free from suction devices. In other words, differing from the object of Reference 5, it is not possible to discharge a part of the resultant water through the inside of the roll. Accordingly, the amount of water which is thrown outwards into the inside of the belt loop is particularly large. However, by the use of the inventive features it is possible to conduct by far the predominant part of this amount of water along the aforementioned guide wall over the support roll into the main chamber of the collecting container and then through same laterally to the outside. At the same time, separately from this, the portion of water thrown off within the region of the support roll is transported outward through at least one additional chamber of the collection container. Particularly favorable results are obtained if the leading front edge of the cover wall of the container is extended as far as possible into the wedge-shaped gap which is located between the dewatering roll and the discharging wires. In accordance with another embodiment of the invention, an additional guide wall covers over the upper region of the dewatering roll for deflecting water that is thrown off the top of the dewatering roll. There is an exit groove connected with the additional guide wall. The additional guide wall is attached to and extends rearwardly over the dewatering roll, from the upstream front edge of the guide wall. In accordance therewith, the generally only small portion of water which is still thrown off from the dewatering roll downstream of the front edge of the guide wall (cover wall) as seen in the direction of rotation is fed by an additional guide wall (overhead) to a trough which has an exit channel of its own. In this case thus a total of at least three exit channels is present.

BRIEF DESCRIPTION OF THE DRAWINGS

FIG. 1 shows the wire end of a twin-wire paper machine, shown diagrammatically;

FIG. 2 shows on a larger scale a portion of FIG. 1, in particular the water collection container, seen in longitudinal section along the line II—II in FIG. 4;

FIG. 3 shows a cross section through the paper machine along the line III—III of FIG. 2;

FIG. 4 is a horizontal section along the line IV—IV of FIG. 2;

FIG. 5 shows a different embodiment of the collection container than that shown in FIG. 2, seen in section along the line V—V of FIG. 6;

FIG. 6 is a section along the line VI—VI of FIG. 5;

FIG. 7 shows another construction of the collection container which differs from that of FIGS. 2 and 5;

FIG. 8 is a horizontal section along the line VIII—VIII of FIG. 7;

FIG. 9 shows the wire end and the press end of a twin-wire paper machine which is modified as compared with FIG. 1;

FIG. 10 shows a twin-wire paper machine with vertical feeding of pulp from above;

FIG. 11 shows a twin-wire paper machine with feeding of pulp from below;

FIG. 12 shows an example in which the formation of a web of fiber takes place between a wire and a slide shoe.

MANNERS OF CARRYING OUT THE INVENTION

The essential parts of the device shown in FIG. 1 are a head box 20, lower wire 21 and upper wire 22. The latter is the porous belt mentioned in above. The forming of a paper web takes place in customary manner on the lower wire 21 in the region of a horizontal pre-dewatering path 23. Thereupon the web of paper which is still to be further dewatered passes through a twin-wire zone 24 formed by the two wires 21 and 22. The initial region of the twin wire zone 24 is located at a dewatering roll 25 arranged in the loop of the upper wire 22. This roll is free of suction devices; it is provided on its water impervious shell with a storage volume for backwater which is removed from the paper web in upward direction. The storage volume is formed by recesses, for instance blind holes, peripheral grooves or a known honeycomb covering. The two wires 21 and 22 move obliquely upward from the dewatering roll 25, the point of separation being located in the lower ascending quadrant. Shortly downstream this the two wires wrap around the upper region of a support roll 26 which is arranged in the loop of the lower wire 21. Thereupon the two wires travel obliquely downward until they have again approximately reached the height of the pre-dewatering zone (at a guide roll 27). Further guide rolls for the upper wire are designated 28. The lower wire 21 is furthermore conducted in known manner over the following rolls: breast roll 30, wire suction roll 31, drive roll 32 and guide rolls 33. The web of paper is fed to the following parts of the paper machine by means of a felt 34 and a pick-up roll 35.

Within the loop of the upper wire 22 there is provided a collection container in the form of a trough 36 for the backwater which is thrown in part out of the dewatering roll 25 and in part, within the region of the support roll 26, out of the upper wire 22. For a small part of the backwater which leaves the dewatering roll only in its upper region, a cover plate 37 with an additional collection trough 38 is provided.

As can be noted particularly clearly from FIGS. 2 to 4, the trough 36 is developed in the manner that the space which is defined by the guide roll 27 and the upper wire 22 coming from the support roll 26 is utilized in the best possible manner. The trough 36 has an upward directed cover wall 40 which extends (opposite to the direction of travel of the wire) over the support roll 26 up to close to the shell of the dewatering roll 25. There it forms a so-called front edge 41 at which the aforementioned guide plate 37 also commences. From the bottom 42 of the trough which is arranged as low as possible, a vertical partition 43 extends upward over about three-fourths of the entire inside height of the trough 36. This partition 43 extends transverse to the direction of travel of the wire through the entire collection trough so that the latter is subdivided into two chambers 44 and 45. The partition 43 together with a cross beam 46 serves at the same time to stiffen the "double trough" 36.

In order to achieve optimum utilization of space the following arrangement is employed: The partition 43 is arranged diagonally. Accordingly, the cross beam 46 has a cross section which increases from one side of the machine to the other (see FIG. 4). Furthermore, each of the two chambers 45 and 46 has, seen from above, a narrow end and a wide end, lateral outlet channels 47 and 48 respectively being provided on the wide ends. The portions of water thrown out of the dewatering roll 25 (in front of the front edge 41 as seen in the direction of rotation) are represented by arrows 50 in FIG. 2. This is the main portion of the water thrown off. On the other hand, arrows 51 indicate those portions of water which emerge from the upper wire 22 in the region of the support roll 26. The amount of backwater obtained at 50 is considerably greater-particularly with high machine speeds, e.g. above 800 meters per minute-than the amount of backwater obtained at 51. Furthermore, the main portion of water 50 has a higher velocity of flow since it is obtained in the form of relatively dense water jets. In this way this portion of water can be guided along the upwardly arched cover wall 40 over the cross beam 46 and the partition 43 into the chamber 45, hereinafter referred to as the "main chamber." The remaining portions of water 51 pass into the other chamber 44.

In addition to the separating of the two chambers 44 and 45 it is also essential tha the main chamber 45 have a number of guide vanes 52. They deflect the machine-wide water jet entering at high speed into the main chamber from above in the direction towards the outlet channel 48. The guide vanes 52 divide the oncoming machine-wide water jet into individual streams, represented by arrows 53 in FIG. 3. These different streams of water 53 after emerging from the row of vanes 52 are stratified above one another and transported outward in this form through the exit channel 48. For this purpose the row of vanes 52, as shown in FIG. 3, is so inclined transverse to the direction of travel of the wire that the exit edges of the guide vanes lie on a plane which ascends in the direction towards the exit channel 48.

In FIGS. 3 and 4 the driver-side longitudinal support 55 and the driven-side longitudinal support 56 of the wet end are indicated in dash-dot lines. The receiving trough 36 is fastened on these longitudinal supports. At the front upper edge of the smaller chamber 44 a ledge 49 which serves to guide the wires 21 and 22 may be arranged. It may under certain circumstances be advantageous to draw air into the inside of the double trough 36 within the region of this ledge 49, i.e. opposite the direction of travel of the wire. In this way the wire 22 can be substantially prevented from carrying water downward with it. A suction device is shown in dot-dash lines at 39. As a result of the invention the quantity of air transported by the centrifuged water into the container 6 is, it is true, substantially reduced as compared with what was previously the case. However, the flow of air which may possibly still remain (enriched with water) can be conducted outwards by the said suction device.

In the embodiment shown in FIGS. 2 to 4, the guide vanes 52 extend transversely through the entire main chamber 45, i.e. they are fastened at one side to the partition 43 and on the other side to the outer chamber wall 57, as a result of which the double trough 36 is provided with additional reinforcement. Differing from this, in the embodiment shown in FIGS. 5 and 6 a number of relatively narrow curved guide plates 58 are provided, first of all, in the rear region of the cover wall **40*a*. They deflect the flow in the direction towards the exit channel even before entrance into the main chamber 45*a*. In addition, however, a number of flat triangular guide plates 59 are so arranged on the rear chamber wall 57*a*** that a plurality of grooves lying one behind the other are produced, of a shape similar to a tetrahedron.

The embodiment shown in FIGS. 7 and 8 is intended for paper machines of lower operating speed. Here the partition wall **43*b* which divides the trough 36*b* into two chambers 44*b* and 45*b* is extended into the upper region of the support roll 26. It is assumed that the main portion of water 50*b* coming from the dewatering roll 25 does not lay itself against the cover wall 40*b* but rather (guided in part by the upper wire 22) passes onto the top of the partition wall 43*b*. In this case therefore the partition wall 43*b* is the guide wall. By guide plates 18** fastened to it, the water is deflected in the direction towards the exit channel.

By this construction the following can furthermore be provided: A suction device indicated at **39*b* (source of vacuum V) can be connected to the front or upstream chamber 44*b* (as seen in the direction of travel of the wire). Furthermore, openings 60 can be provided in the lowermost region of the partition wall 43*b*. If a quantity of water greater than expected is obtained in the main chamber 45*b*, a part of this water can then pass through the opening 60 into the front chamber 44*b***.

From FIGS. 9 and 10 it can be seen that the invention can also be employed with paper machines or other dewatering machines which differ from the construction shown in FIG. 1. In the twin-wire paper machine of FIG. 9 the dewatering roll **25*c* arranged in the upper wire 22*c* can be developed either (like that of FIG. 2) without suction device or as suction roll (as indicated in FIG. 9). It is wrapped over a larger part of its periphery (as compared with FIG. 1) by the two wires 21*c* and 22*c*. The point of departure of the two wires lies in the upper ascending quadrant of the dewatering roll 25*c*. Also in the case of this manner of construction, the dewatering roll throws a large part of the water arriving into the inside of the upper wire 22*c* behind or downstream of the point of departure off in the form of relatively compact water jets. Smaller amounts of water are obtained in the descending quadrant of the dewatering roll. In the region of this side of the roll a collection container (double trough) 36c is arranged which in its turn is divided into two chambers 44c and 45c by a (preferably diagonal) partition wall 43c. The chamber 45c which is at the greater distance from the dewatering roll is again the main chamber. At the point of departure of the wire from the dewatering roll 25c a so-called jet guide shoe 65 can be arranged which is preferably developed in accordance with German patent application Ser. No. P 31 23 131.4-27. The bottom of the jet guide shoe 65 and an extension 40c which adjoins it here form the guide wall. The portion of water flowing into the main chamber 45b is in its turn deflected by guide vanes 52c in the direction towards an exit channel. This example shows that the guide wall 40c need not necessarily be connected as shown in FIG. 2 or 5 to the outer wall 57c of the main chamber 45c but can also terminate in the central region of the main chamber 45c. In this case the guide wall 40c is connected to the partition wall 43c via the guide vanes 52c**.

A double trough 36d in accordance with the invention can also be arranged in the press end on a suction press roll 25d. Otherwise the roll arrangement of FIG. 9 is known: A pick-up belt 43 travels over a pick-up suction roll 35a, takes off the paper web 19 there from the lower wire 21c and conducts it with its lower side into a first press nip which is formed by the aforementioned suction press roll 25d and a lower roll 66 and through which there also travels a lower felt 34b. Behind the first press nip the pick-up felt 34a together with the paper web 19 wrap around the suction roll 25d and then pass through a second press nip which is formed with a stone roll 67. In exceptional cases, a considerable amount of water may also be thrown off at the pick-up suction roll 35a so that a double trough in accordance with the invention could be arranged here also; it would have essentially the shape of the double trough 36e shown in FIG. 10.

In the case of the twin-wire end shown in FIG. 10, a dewatering roll 75 is arranged on the end of a vertical twin-wire dewatering zone 73 which is formed by two wires 71 and 72. The two wires wrap only around the lower descending quadrant of the dewatering roll 75; i.e., the place of departure is located approximately at the lower vertex line of the dewatering roll 75. The shape of the double trough 36e arranged behind the dewatering roll is adapted to these circumstances.

The invention can also be employed if-differing from FIG. 2 or 7-the two wires 21 and 22 are guided only over the support roll 26 in the twin-wire dewatering zone; i.e. in this case the roll 25 is not a dewatering roll but a pure wire guide roll (corresponding to Reference 2).

A similar case is present with the twin-wire paper machine shown in FIG. 11. Here a so-called forming cylinder 83 is wrapped predominantly in its upper region by a lower wire 81 and an upper wire 82. The wires form a wedge-shaped inlet nip which is open towards the bottom; into it there discharges the outlet opening of a nozzle head box 80. The web of paper is formed between the two wires, the dewatering taking place entirely or predominantly through the upper wire 82. The portions of water thrown off in the initial region of the twin-wire zone pass into a lower collection trough 88 which is arranged laterally alongside the cylinder 83. The portions of water thrown off in the upper region can be divided, similar to the case of FIG. 2, into a portion of main water which is compacted on an upwardly curved guide wall 86 and into the smaller portions of water which are still thrown off at the end of the twin-wire zone and are collected in a chamber 84. Due to the particularly limited space conditions the portion of main water is-differeing from FIG. 2-deflected above the chamber 84 by another guide wall 87 into the opposite direction and finally passes into the main chamber 85 present above the trough 88. Upon entrance into it, the water is again deflected by guide vanes 89 towards a lateral exit channel. This compact construction permits great freedom in selection in the arrangement of the wire guide rolls and thus freedom of selection in the direction of the exit jet of the breast box 80.

Finally, FIG. 12 shows an arrangement in which (corresponding to German patent application Ser. No. P 31 28 156.7-27) a slide shoe 91 is arranged at the outlet opening of a head box 90, over which slide shoe a wire 92, guided by a ledge 93, travels. Thus the slide shoe 91 and the wire 92 define a curved web-forming zone within which a considerable amount of water is thrown off into the inside of the wire loop, namely obliquely upwards in the case FIG. 12. Therefore the double trough 96 of the invention can be used in this case also. The web of paper adhering to the bottom of the wire 92 in FIG. 12 is brought together at 94 with another web of paper which is formed on a second wire 95.

We claim:

1. A device for continuous dewatering of a web of fiber material in a paper making machine comprising:

(a) an endless porous belt for water to pass through, the belt forming a loop; horizontally oriented guide rolls for guiding and moving the belt around said guide rolls; a second belt cooperating with the first mentioned belt, the belts forming a twin-belt zone; the said fiber web to be dewatered being guided between the belts;

(b) said twin-belt zone being located in the lower region of the first belt;

(c) the guide rolls defining such a path for the belts and causing the belts to move at such speed that at least part of the water which has been removed from the said fiber web in the twin-belt zone penetrates through the first belt and is thrown off the first belt from below upwards into the interior of said loop (d) one of the guide rolls for the first belt being a dewatering roll which is located inside said loop in the twin-belt-zone;

(e) the dewatering roll being located in the lower region of the path of the first belt; the first belt therefore passing at least predominantly around the bottom side of the dewatering roll;

(f) the dewatering roll including an external shell with recesses defined in the shell which receives water from the first belt in the region where the first belt is wrapped around the dewatering roll, and beyond where the belts are guided off the dewatering roll, the said dewatering roll throwing off water from below upwards into the interior of said loop;

(g) a container placed inside said loop for receiving water thrown off the first belt and off said dewatering roll;

(h) the container being divided into two separate water containing chambers, each chamber extending across the width of the belts; each chamber extending across the width of the belts; each chamber having a water exit therefrom individual thereto;

(i) the exit from one chamber being at one lateral side of the container and the exit from the other chamber being at the opposite lateral side of the container; each container being shaped so that the respective inside width of each chamber, measured along the path of the belt, increases laterally along the container in the direction toward the respective exit from that chamber;

(k) a guide wall above the area from which the water is thrown, said guide wall being positioned to be struck by the water thrown off the first belt and off said dewatering roll and directing the thrown off water into the container;

(l) the guide wall being shaped and positioned to direct the more dense jets of water into one of the chambers of the container; the remaining water passing into the other chamber.

2. The device of claim 1, further comprising a row of guide surfaces supported by the container in the first chamber; each of the guide surfaces extending generally transversely to the direction of movement of the belt past the container for deflecting flow of water in the chamber toward one lateral side of the first chamber; the exit from the first chamber being at the side of the first chamber toward which the water is deflected.

3. The device of claim 1, in which the guide wall has an upstream front edge where the water starts to be thrown off from the belt; the guide wall also being spaced from the opposite surface of the belt for defining the path of thrown off water between the front edge of the guide wall and the opposite surface of the belt.

4. The device of claim 3, wherein the guide wall is upwardly arched generally following the path of flow of water off the belt.

5. The device of claim 1, wherein each chamber has a respective cross-section for flow, and in at least one of the chambers, there is a passage into the respective exit from that chamber which passage is free of constriction of the cross-section of flow.

6. The device of claim 1, wherein the water is thrown off the belt and flies initially predominantly upwardly;

the chambers being arranged with the first one of the chambers being located after the second one of the chambers in the path along which the water is thrown; and the first chamber which receives the greater amount of thrown off water is the chamber further away from the place where the water is thrown off the belt.

7. The device of claim 1, further comprising vacuum producing means connected with the container for drawing off air from the container.

8. The device of claim 1, wherein the chambers are separated by a wall in the container.

9. The device of claim 8, in which the guide wall has an upstream front edge where the water starts to be thrown off from the belt; the guide wall also being spaced from the opposite other surface of the belt for defining the path of thrown off water between the front edge of the guide wall and the opposite surface of the belt;

the wall extending upstream to the location where the water starts to be thrown off.

10. The device of claim 9, wherein the two chambers are at least substantially sealed from each other for enabling different pressures to be established in the two chambers.

11. The device of claim 1, wherein the two chambers are at least substantially sealed from each other for enabling different pressures to be established in the two chambers.

12. The device of claim 1, wherein the belt is a felt belt; the guiding rolls include a dewatering roll located in the lower region of the belt, and the guiding rolls include a roll press section for pressing on the felt belt for dewatering, and the dewatering roll comprises a suction press roll.

13. The device of claim 1, wherein one of the guiding rolls is a forming cylinder; the first belt is located above the second belt at the forming cylinder; together at the forming cylinder, the first and second belts define a wedge-shaped inlet nip;

a head box for spraying pulp, or the like, into the nip;

the first and second belts having their inlet nip defined at the forming cylinder, below the upper vertex of the forming cylinder with respect to the direction of rotation of the forming cylinder; the belts move together around the forming cylinder and move together off the forming cylinder downstream of the upper vertex of the forming cylinder;

the guide wall of the container being comprised of two sections, the first section of the guide wall being shaped to extend over and being spaced from the forming cylinder for conducting the main portion of water thrown off the belts while the belts move around the forming cylinder in the direction of rotation of the forming cylinder, the first section of the guide wall extending up around the forming cylinder to an end thereof which is in the region of the upper vertex line of the forming cylinder; and the second section of the guide wall being placed beyond the end of the first section thereof; the second section being for receiving water passing around and thrown beyond the first section, for guiding that water in the reverse direction of travel; one of the chambers being placed for receiving water guided thereto by the second section of the guide wall; the one chamber being located in the region of the upper ascending quadrant of the forming cylinder.

14. The device of claim 1, further comprising a guide shoe shaped for deflecting the belt and also shaped and placed to cause the belt to throw off water; the belt being guided by the guiding rolls and the like over the guide shoe for throwing off water from the belt; the container being placed to receive water thrown off the belt at the guide shoe;

a head box for spraying pulp, or the like, and the head box being located just upstream of the guide shoe in the path of the belt for providing to the belt the pulp to be dewatered on the belt;

the guide wall of the chamber extending over the zone including the spray out of the head box and the curved slide shoe.

15. The device of claim 1, wherein the guiding rolls for the first belt being placed for causing the first belt to separate from the dewatering roll in the lower ascendant quadrant of the dewatering roll;

the guiding rolls for the first belt further including a support roll on the side of the second belt away from the first belt and located downstream of the dewatering roll; the support roll being placed for guiding the first belt to ascend around the dewatering roll and also for defining the place of separation of the first belt from the dewatering roll; and the container being located downstream of the support roll in the path of the first belt.

16. The device of claim 15, in which the guide wall has an upstream front edge where the water starts to be thrown off from the belt; the guide wall also being spaced from the opposite other surface of the belt for defining the path of thrown off water between the front edge of the guide wall and the opposite surface of the belt; the upstream front edge of the guide wall being arranged within a wedge-shaped nip that is defined between the dewatering roll and the first belt.

17. The device of claim 16, further comprising an additional guide wall for covering over the upper region of the dewatering roll for deflecting water that is thrown off the top of the dewatering roll; an exit groove connected with the additional guide wall.

18. The device of claim 17, wherein the additional guide wall is attached to and extends rearwardly over the dewatering roll from the upstream front edge of the guide wall.

19. The device of claim 16, wherein the upstream front edge of the guide wall is spaced away from the dewatering roll a smaller distance than it is spaced from the first belt.

20. The device of claim 19, wherein the first belt is wrapped around the dewatering roll over an angle, starting from the lower vertex of the dewatering roll, of between 45°–60°;

the upstream front edge of the guide wall lies approximately at, but slightly below, the height of the axis of the dewatering roll.

21. A device for continuous dewatering of a web of fiber material in a paper making machine, or the like, comprising:

a porous belt for water to pass through, and horizontally oriented guide rolls and the like for guiding and moving the belt for movement longitudinally of the belt; the belt having one surface adapted to receive thereon a fiber web to be dewatered, and the belt also having an opposite other surface;

the guide rolls and the like define such a path for the belt and cause the belt to move at such speed that at least part of the water which has been removed from the fiber web penetrates through the belt and is thrown off the opposite surface of the belt;

a container placed near the belt opposite surface for receiving water thrown off the belt opposite surface; the container being divided into two separate water containing chambers, and each chamber extending across the width of the belt; each chamber having a respective water exit therefrom;

a guide wall above the area from which the water is thrown, said guide wall being positioned to be struck by the water thrown off the belt and to direct the thrown off water into the container; the guide wall being shaped and positioned to direct the more dense jets of water into a first one of the chambers of the container;

the said belt being in the form of an endless loop; said web being received against the one surface which is the outside surface of the loop, and the container being positioned at the inside of the loop of the belt and a second belt for cooperating with the first-mentioned belt, said second belt being positioned and adapted to press a web between the first and second belts in the vicinity of the container;

the exit from one chamber being at one lateral side of the container and the exit from the other chamber being at the opposite lateral side of the container;

the said container being shaped so that the respective inside width of each chamber, measured along the path of the belt, increases laterally along the container in the direction toward the respective exit from that chamber;

one of the guide rolls for the first belt comprising a dewatering roll which is located toward the lower region of the path of the first belt; the first belt passes at least predominantly around the bottom side of the dewatering roll; the dewatering roll including an external shell with recesses defined in the shell which receive water from the first belt in the region where the first belt is wrapped around the dewatering roll, and beyond where the belt is guided off the dewatering roll, the said dewatering roll throwing off water.

22. A device for continuous dewatering of a web of fiber material in a paper making machine, comprising:

(a) a lower endless wire belt 21 forming a lower belt loop and a substantially horizontal pre-dewatering path 23; an upper endless wire belt 22 forming an upper belt loop;

horizontally oriented guide rolls for guiding and moving the upper wire belt around said guide rolls;

the upper wire belt cooperating with the lower wire belt;

the wire belts forming a twin-belt zone;

the said fiber web to be dewatered being guided between the wire belts;

(b) one of the guide rolls 25 for the upper wire belt 22 being a dewatering roll located inside said upper belt loop and conducting the upper wire from above downwards on to the substantially horizontal pre-dewatering path of the lower wire belt and forming an initial region of the twin-belt-zone wherein the wire belts being wrapped around the dewatering roll up to a point of departure;

(c) the point of departure of the wire belts from the dewatering roll lying in the lower ascendant quadrant of the roll shell;

(d) the wire belts wrapping, directly behind the dewatering roll as seen in the direction of travel together with the fiber web therebetween, around a support roll arranged within the lower belt loop, with the wire belts travelling downward from the support roll;

(e) the dewatering roll including an external shell with recesses defined in the shell, said recesses receiving water from the upper wire belt in said initial region of the twin wire zone, the said dewatering roll, throwing off said water out of said recesses from below upwards into the interior of the upper belt loop;

(f) a container 36 placed inside said upper belt loop for receiving water thrown off the upper wire belt and off said dewatering roll;

said container being arranged behind the support roll 26 as seen in the direction of travel of the wire belts;

(g) a guide wall 40 being placed inside said upper belt loop and being positioned to be struck by the water thrown off the first wire belt and off said dewatering roll and directing the thrown off water into the container;

said guide wall 40 being at the same time a covering wall of the container 36 and having a front edge 41 which is arranged within the wedge-shaped nip present between the dewatering roll and said wire belts (near said point of departure);

(i.) the upper region of the dewatering roll 25 being covered by an additional guide wall 37 for water which has been slung off;

an exit groove 38 being connected to the additional guide wall;

the additional guide wall 37 being connected to said front edge 41 of the first-mentioned guide wall 40.

23. A device according to claim 22, characterized by the fact that the distance of the front edge from the shell of the dewatering roll is less than the distance from the wire belt.

24. A device according to claim 22 in which the angle of wrap of the wire belts on the dewatering roll amounts -starting from the lower vertex line-to between 45° and 60°, characterized by the fact that the front edge of the guide wall lies at least approximately at the height of the axis of rotation of the dewatering roll and preferably slightly below same.

25. The device of claim 22 wherein the path of the porous belt, said twin-belt zone being located in the lower region of the first belt.

26. The device of claim 25 wherein the guide rolls defining such a path for the belts and causing the belts to move at such speed that at least part of the water which has been removed from the said fiber web in the twin-belt zone penetrates through the first belt and is thrown off the first belt from below upwards into the interior of said loop.

27. The device of claim 26 wherein one of the guide rolls for the first belt comprises a dewatering roll which is located inside said loop in the twin-belt-zone.

28. The device of claim 22 wherein the container is divided into two separate water containing chambers, each chamber extending across the width of the belts; each chamber having a water exit therefrom individual thereto.

29. The device of claim 28 wherein the exit from one chamber is at one lateral side of the container and the exit from the other chamber is at the opposite lateral side of the container; each container being shaped so that the respective inside width of each chamber, measured along the path of the belt, increases laterally along the container in the direction toward the respective exit from that chamber.

30. The device of claim 29 wherein the guide wall is shaped and positioned to direct the more dense jets of water into one of the chambers of the container; the remaining water passing into the other chamber.

31. The device of claim 30, wherein each chamber has a respective cross-section for flow, and in at least one of the chambers, there is a passage into the respective exit from that chamber which passage is free of constriction of the cross-section of flow.

32. The device of claim 31, wherein the water is thrown off the belt and flies initially predominantly upwardly;

the chambers being arranged with the first one of the chambers being located after the second one of the chambers in the path along which the water is thrown; and the first chamber which receives the greater amount of thrown of water is the chamber further away from the place where the water, is thrown off the belt.

33. The device of claim 6, wherein both first and second chambers have respective lower limiting walls for defining their bottom sides, and these lower limiting walls have substantially the same geodetic height, but the inside height of the first chamber is greater than the inside height of the second chamber.

34. The device of claim 32, wherein both the first and second chambers have respective lower limiting walls for defining their bottom sides, and these lower limiting walls have substantially the same geodetic height, but the inside height of the first chamber is greater than the inside height of the second chamber.

* * * * *